US009103058B2

(12) United States Patent
Chien

(10) Patent No.: US 9,103,058 B2
(45) Date of Patent: Aug. 11, 2015

(54) INSULATED ARTICLE THAT CHANGES FILL POWER THROUGH DISPLACEMENT ADJUSTMENT

(75) Inventor: Jung-Fu Chien, Los Angeles, CA (US)

(73) Assignee: INTERBOND CO., LTD., New Taipei (TW)

( * ) Notice: Subject to any disclaimer, the term of this patent is extended or adjusted under 35 U.S.C. 154(b) by 228 days.

(21) Appl. No.: 13/584,086

(22) Filed: Aug. 13, 2012

(65) Prior Publication Data

US 2014/0044952 A1 Feb. 13, 2014

(51) Int. Cl.

| | |
|---|---|
| ***B32B 3/00*** | (2006.01) |
| ***B32B 3/28*** | (2006.01) |
| ***D04H 1/70*** | (2012.01) |
| ***D04H 1/736*** | (2012.01) |

(52) U.S. Cl.
CPC . *D04H 1/70* (2013.01); *D04H 1/736* (2013.01)

(58) Field of Classification Search
CPC ..... B32B 3/00; B32B 3/28; D04H 1/70; D04H 1/736; D04H 1/74
USPC ..... 428/175, 176, 181, 182, 186, 74
See application file for complete search history.

(56) References Cited

U.S. PATENT DOCUMENTS 5,008,141 A * 4/1991 Shinozuka ..... 428/182

FOREIGN PATENT DOCUMENTS

| | | |
|---|---|---|
| DE | 4220338 A1 | 1/1994 |
| EP | 0741827 B1 | 11/1996 |

OTHER PUBLICATIONS

German Examination Report for application 10 2012 015 569.7 dated Jun. 7, 2013.

* cited by examiner

*Primary Examiner* — Catherine A Simone
(74) *Attorney, Agent, or Firm* — patenttm.us

(57) ABSTRACT

An insulated article that changes its fill power through adjustment in displacement is provided. Outer and inner surfaces of a folded web consisting of slanting lapped continuous filaments tow band are attached with an outer shell fabric and a lining fabric made of nonwoven or cloth, respectively. This forms a sandwich structure similar to the birds' down feathers underneath the contour feathers. By adjusting the horizontal displacement between the outer and lining fabrics, the fill power (or fluffiness) of the folded web can be changed. Thus, the present invention is applicable to products such as sleeping bags, duvets, snow suits, snow boots and the like. It also has sound and heat proof properties as well as better thermal insulation.

7 Claims, 7 Drawing Sheets

INSULATED ARTICLE THAT CHANGES FILL POWER THROUGH DISPLACEMENT ADJUSTMENT

BACKGROUND OF THE INVENTION

1. Field of the Invention

The present invention relates to an insulated article that changes its fill power through adjustment in displacement, and more particularly, to an insulated article that obstructs air circulation, thermal conduction and thermal radiation with a high fill-power and low-density structure.

2. Description of the Prior Art

In order to allow sleeping bags, quilts or snow suits and other products to have, but not limited to, thermal insulation and lightweight properties, it is necessary for their internal fiber structures to be low density but exhibit high fluffiness, similar to the down feathers beneath a bird's tougher exterior feathers. When a bird stretches its wings, the low-density down feathers are opened up into a loose and fluffy state to trap air and help insulate the bird.

A traditional insulated article, such as the structure shown in FIG. 1, typically employs a cross-laminated forming method to produce a laminated web (1*a*). The thickness (h) of the laminated web (1*a*) represents the fill power (fluffiness) of the laminated web (1*a*), and the thickness (h) of the insulated article before compression is at its optimal fill power. When the insulation article is compressed for storage, its thickness (h) is compressed and can reduce down to the thickness, or volume, of condensed continuous filaments tow felt. The insulated article is uncompressed before usage. However, when no external force is exerted to separate the fibers, the laminated web (1*a*) generally recovers to less than 85% of its original thickness (h), or fill power, before compression, due to cohesion and friction between fibers.

Traditional insulated articles cannot sustain the original high fluffiness while maintaining low density and thus, cannot provide a lightweight structure that has good prolonged thermally insulation properties.

From the above, the drawback of the prior art is exposed. There is a need in the industry for a novel design that solves the problem of fill power recovery.

SUMMARY OF THE INVENTION

In view of the prior-art drawbacks and in order to address the needs of the industry, the present invention provides an insulated article that changes its fill power through adjustment in horizontal displacement of two parallel fabrics attached to a folded web. It was developed based on feather arrangements found in birds. Spread continuous filament tow band is swung at a predetermined angle to form a folded web, and an outer shell fabric and a lining fabric are adhered to the top and bottom surfaces of the inclined folded web, respectively, by press rollers and adhesive, to form the sandwich structure of the present invention.

The folded web moves in linkage with the top and bottom fabrics. When pressure is applied to the insulated article, the outer and the lining fabrics compress the slanting layered folded web to fill power toward the thickness, or volume, of condensed continuous filaments tow felt. The horizontal displacement between the outer and the lining fabrics is decreased to open up the insulated article. As a result, a bridge-like structure formed by linking an adhered short lap section and the outer and lining fabrics reflects the displacement, so a non-adhered long lap section is moved from a compressed state to an expanded state. The fluffy fibers will then fill up the gaps formed in the folded web due to the changes in the horizontal displacement, thus forming low-density regions in the structure. As such, the insulated article may restore its original thickness (or fill power) of the folded web, and by adjusting the fabrics to horizontal displacements, the fill power may even surpass its original fill power, achieving the low-density and high fill-power properties anticipated by the inventors.

Therefore, the present invention essentially adjusts the horizontal displacement between the outer and the lining fabrics so that the folded web may not only its original thickness (or fill power), but surpass its original fill power. The gaps formed after the folded web is restored to its original loft can be filled up by the fluffy long lap section, forming low-density regions of the folded web. The present invention thus provides an insulated article that is highly thermally insulated, lightweight and easy to store, solving various existing problems of the prior art.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

The present invention presents an insulated article that changes its fill power through adjustment in the horizontal displacement between two fabrics attached to a folded web. The outer and inner surfaces of a folded web, formed by a pendulum lapping process, are attached with an outer shell fabric and a lining fabric, respectively, and these three elements form a sandwich structure. By adjusting the horizontal displacement between the outer and lining fabrics, the folded web can recover and even surpass its original thickness and obtain higher fill power than the original fill power of the folded web. In addition, during the recovery process, the long lap sections not adhered to the fabrics fill up the gaps formed in the folded web, forming low-density regions in the structure. Not only does the resulting article possess excellent thermal insulation properties, it can also provide a low density but high fill power structure. This insulated article can be easily compressed or recovered in actual use and thus suitable for, but not limited to, products such as sleeping bags, duvets, snow suits, and snow boots. In addition, it can also be used in sound and heat proof products requiring good thermal insulation that can be easily stored.

In order to fully understand the structure and arrange of the present invention, detailed structures and their compositions are set forth in the following descriptions. The implementations of the present invention are not limited to specific details known to those skilled in the art. On the other hand, well-known compositions or methods are omitted herein to avoid unnecessary limitations on the present invention. Preferred embodiments of the present invention are described in details below, in addition to these descriptions, the present invention can be widely applied to other embodiments, and the scope of the present invention is not limited by such, and rather by the scope of the following claims.

Figure 1:
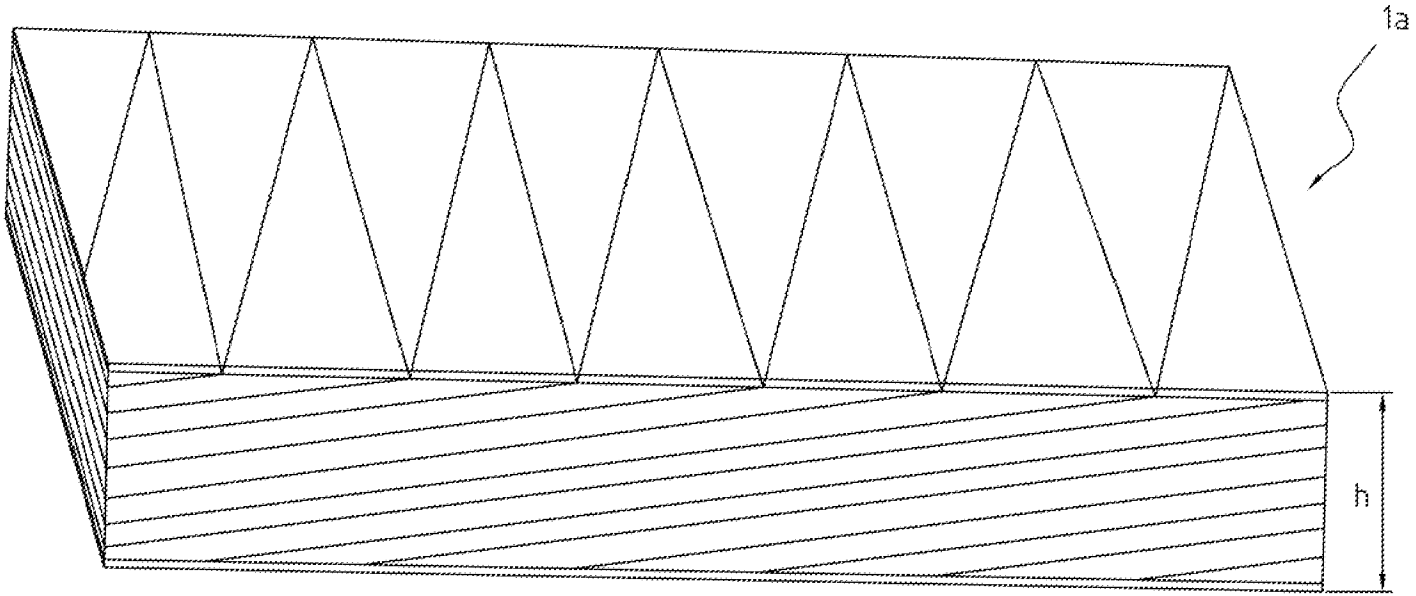
FIG. 1 is a perspective view of the structure of a traditional laminated web.
Figure 2:
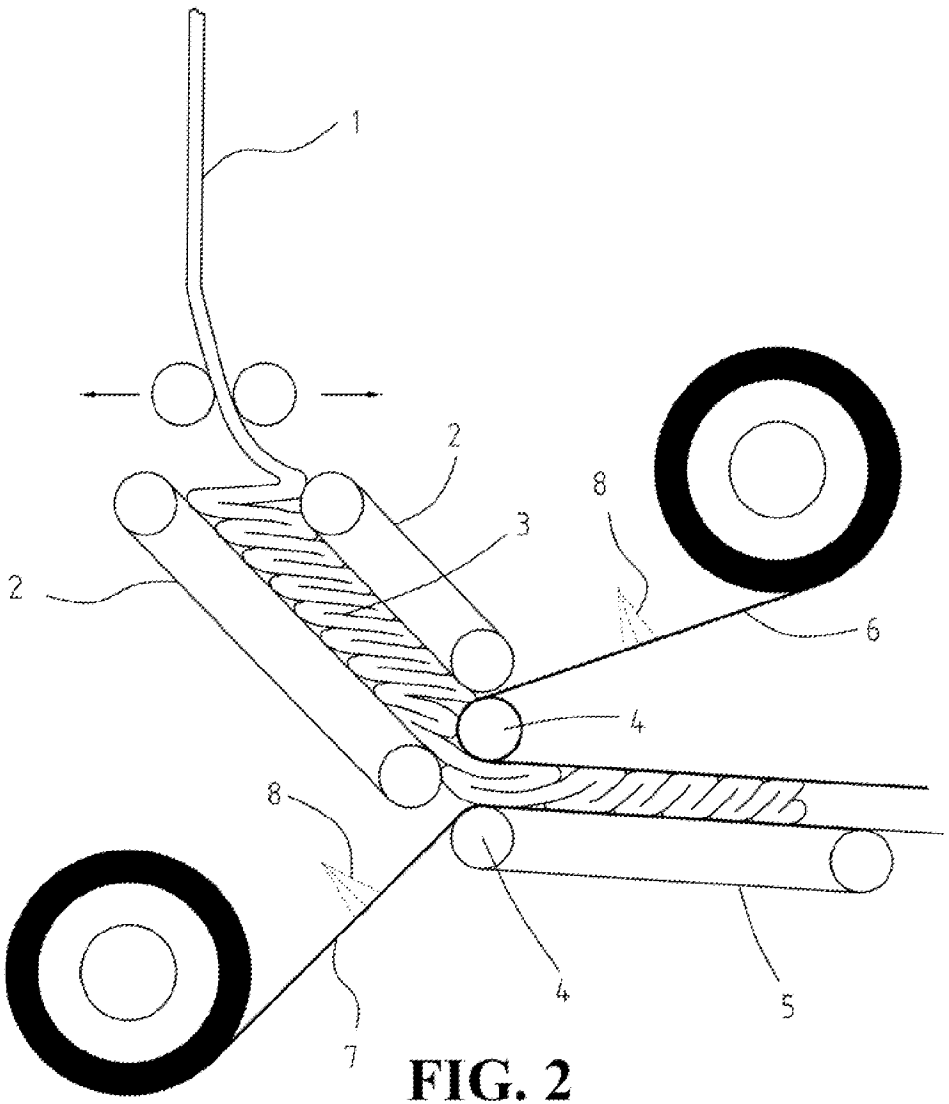
FIG. 2 is a diagram illustrating the manufacturing of an insulated article according to the present invention.

Referring to FIG. 2, a diagram illustrating the manufacturing of an insulated article that changes its fill power through adjustment of horizontal displacement, in accordance to the present invention, is shown. It essentially employs a non-woven manufacturing technique by swinging and lapping a spread continuous filament tow band (1) between a pair of parallel limiters (2). The limiters (2) can be positioned at an inclination so the continuous filament tow band (1) will form a continuous slanting folded web (3), where the angle between each fold and the inclination surface is less than 90°. Then, the folded web (3) formed of slanting folds is passed from the limiters (2) to a flat conveyor belt (5) via a pair of top and bottom press rollers (4), meanwhile, an outer shell fabric (6) and a lining fabric (7) are transferred to the top and bottom surfaces of the folded web (3) via the top and bottom press rollers (4), respectively. An adhesive (8) (such as hot melt glue, etc.) is sprayed onto the attaching surfaces of the outer shell fabric (6) and lining fabric (7) by sprayers before the outer shell fabric (6) and lining fabric (7) are transferred to the folded web (3). Then, pressure is applied to the outer shell fabric (6) and lining fabric (7) to adhere them to the top and bottom surfaces of the folded web (3), respectively, thereby forming a sandwich structure. This resulting structure is then transferred from the flat conveyor belt (5) onto the next stage for further processing such as drying, shaping, edge cutting and rolling up.

Figure 3:
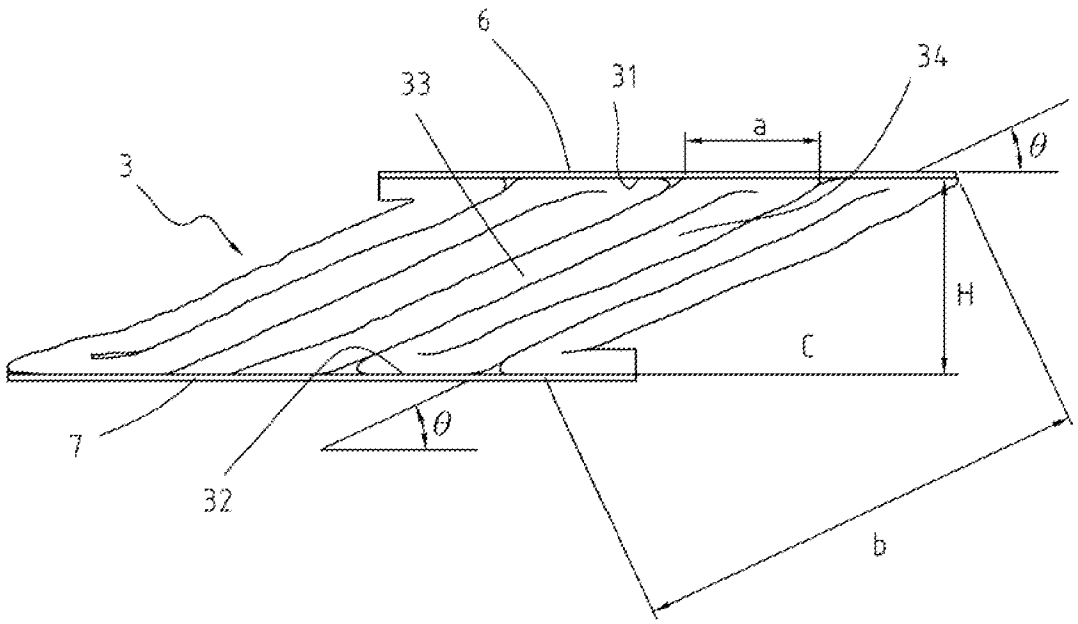
FIG. 3 is a plane view of the insulated article according to the present invention.

Referring now to FIG. 3, the sandwich structure of the insulated article manufactured by the above method is shown including the slanting folded web (3), the outer shell fabric (6) and the lining fabric (7) at the top and bottom surfaces, respectively, of the folded web. The continuous slanting folded web (3) includes multiple laps connected end-to-end sequentially. Each lap of the continuous slanting folded web (3) is characterized by width (a) and length (b) and forms angle (θ) with respect to the outer shell fabric (6) or the lining fabric (7). The section of each lap attached to the outer shell fabric (6) is attachment area (31), and all sections of the laps attached to the outer shell fabric (6) are connected together. Similarly, the section of each lap attached to the lining fabric (7) is attachment area (32), and all sections of the laps attached to the lining fabric (7) are also connected together. Each lap includes a front short lap section (33) and a back long lap section (34) according to its slanting direction. The front short lap section (33) of each lap connects end-to-end to the back long lap section (34) of each lap, and the back long lap section (34) of each lap is non-adhered with the front short lap section of each lap side by side and non-adhered with the front short lap section of the adjacent lap side by side. The front short lap section (33) forms a linked, bridge-like structure with the outer shell fabric (6) via attachment area (31) and with the lining fabric (7) via attachment area (32) with all elements moving in conjunction. On the other hand, the unattached back long lap section (34) is loose and fluffy.

According to the above, a sandwich structure of the insulated article according to the present invention is manufactured, which includes the slanting folded web (3), the outer shell fabric (6) and lining fabric (7) at the top and bottom surfaces, respectively, of the folded web. These three elements constitute the thickness (H) of the structure, which represents the fill power of the insulated article of the present invention.

Figure 6:
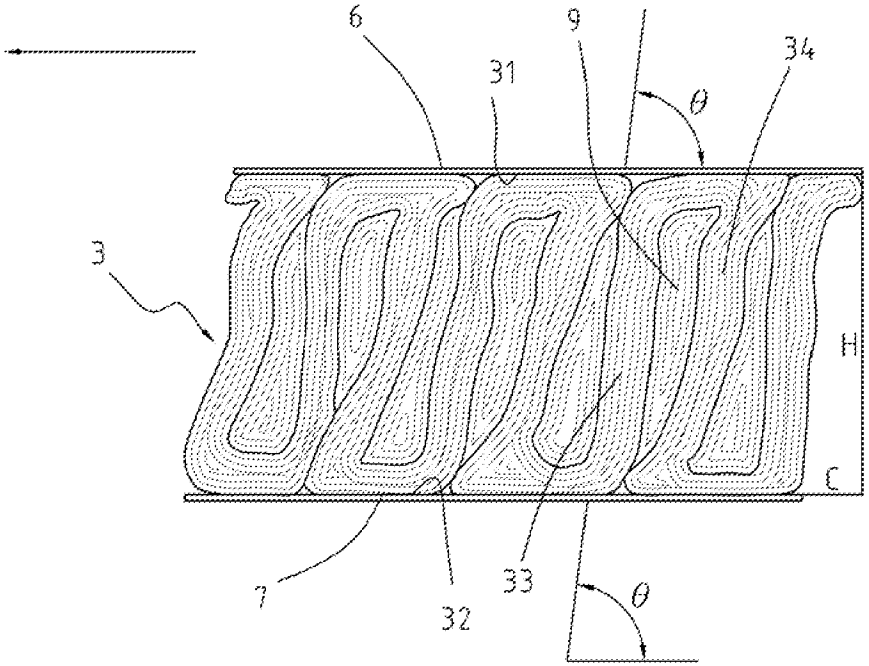
FIG. 6 is a plane view illustrating the insulated article according to the present invention after recovering its fill power.

The change in horizontal distance formed by a certain point on the outer shell fabric (6) and a certain point on the lining fabric (7) represents the horizontal displacement (c) between the outer shell fabric (6) and the lining fabric (7). By adjusting this horizontal displacement (c), the thickness (H) (i.e. fill power) of the folded web (3) is also changed. For example, set the original horizontal distance between the outer shell fabric (6) and the lining fabric (7) to close zero so the angle (θ) formed between each folded lap and the outer shell fabric (6) or the lining fabric (7) is close to 90°, as shown in FIG. 6. Some portions of the folded web (3) form the attachment areas (31) (32), while other, non-adhered portions form alternating short lap section (33) and long lap section (34). The short lap section (33) forms a linked, bridge-like structure with the outer shell fabric (6) and the lining fabric (7) and moves in concert with the attachment areas (31) (32), while the back long lap section (34) is loose and fluffy. When the angle (θ) of the folded web (3) is adjusted to 90° or greater, gaps (9) are formed due to the position adjustment. The fluffy fibers in the portions of the alternating short lap section (33) and the loose long lap section (34) in the folded web (3) not adhered to the outer shell fabric (6) and the lining fabric (7) will then fill up the gaps (9), as can be seen in FIG. 6, to form the low-density regions in the structure of the folded web (3) of the present invention.

Figure 4:
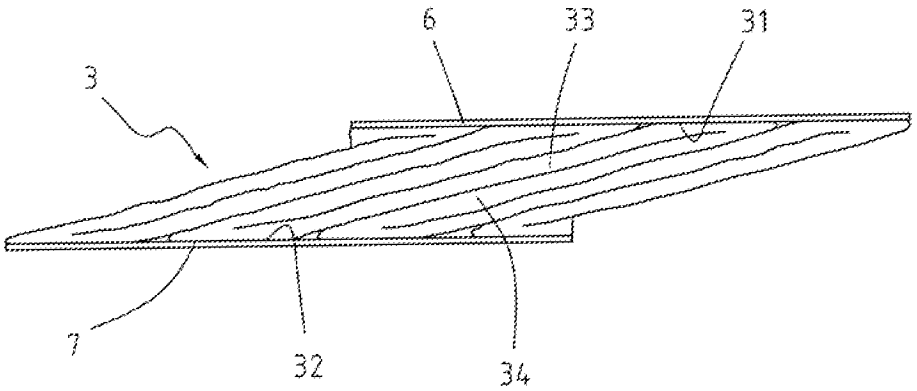
FIG. 4 is a diagram illustrating the insulated article according to the present invention under compression.
Figure 5:
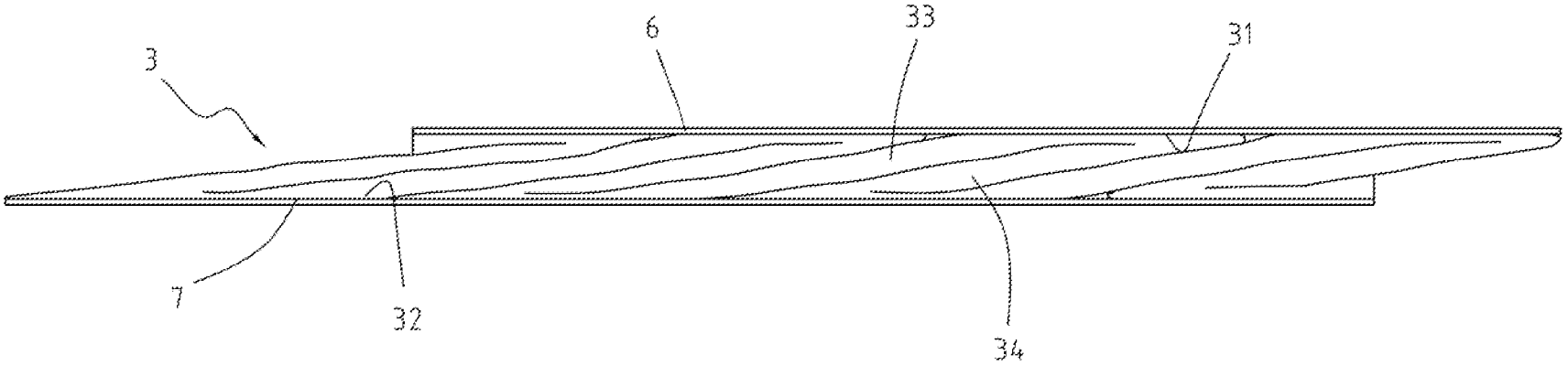
FIG. 5 is another diagram illustrating the insulated article according to the present invention under compression.

Referring to FIGS. 3 to 6 together, the diagrams illustrate the insulated article in which the folded web (3) are at different slanting angles (when pressed or released) as a result of moving in concert with the top outer shell fabric (6) and the bottom lining fabric (7). As shown in FIG. 3, when the insulated article is not under compressed, the slanting layered folded web (3) has slanting laps overlapping each other; its thickness (H) (fill power) is the original thickness (H) of the layered folded web (3). When the insulated article is stored, that is, when pressure is applied to the insulated article, there is a relative displacement between the outer shell fabric (6) and the lining fabric (7). This relative displacement (c) is increased with the increase in pressure (as shown by FIGS. 4 and 5), wherein FIG. 4 shows that the folded web (3) is compressed to 50% of its loft, and the FIG. 5 shows that the folded web (3) at maximum compression, where its fill power approximates the thickness, or volume, of a condensed continuous filaments tow felt. When the insulated article is spread out and to be used again, pressure is released, and the relative displacement (c) between the outer shell fabric (6) and the lining fabric (7) becomes close to zero, or in other words, the angle of the short lap section (33) with respect to the outer shell fabric (6) and the lining fabric (7) is close to or greater than 90°, the structure is in a state as shown in FIG. 6. The loose or non-adhered long lap section (34) changes from being compressed to expanded, and its fluffy fibers fill up the hollow gap (9) in the folded web (3) formed as a result of changes in the angle, thus forming the low-density region of the folded web (3) of the present invention. The folded web (3) of the present invention therefore recovers its original thickness (or fill power), or even surpasses its original thickness (or fill power), exhibiting the low-density and high fill power properties anticipated by the inventors.

Figure 7:
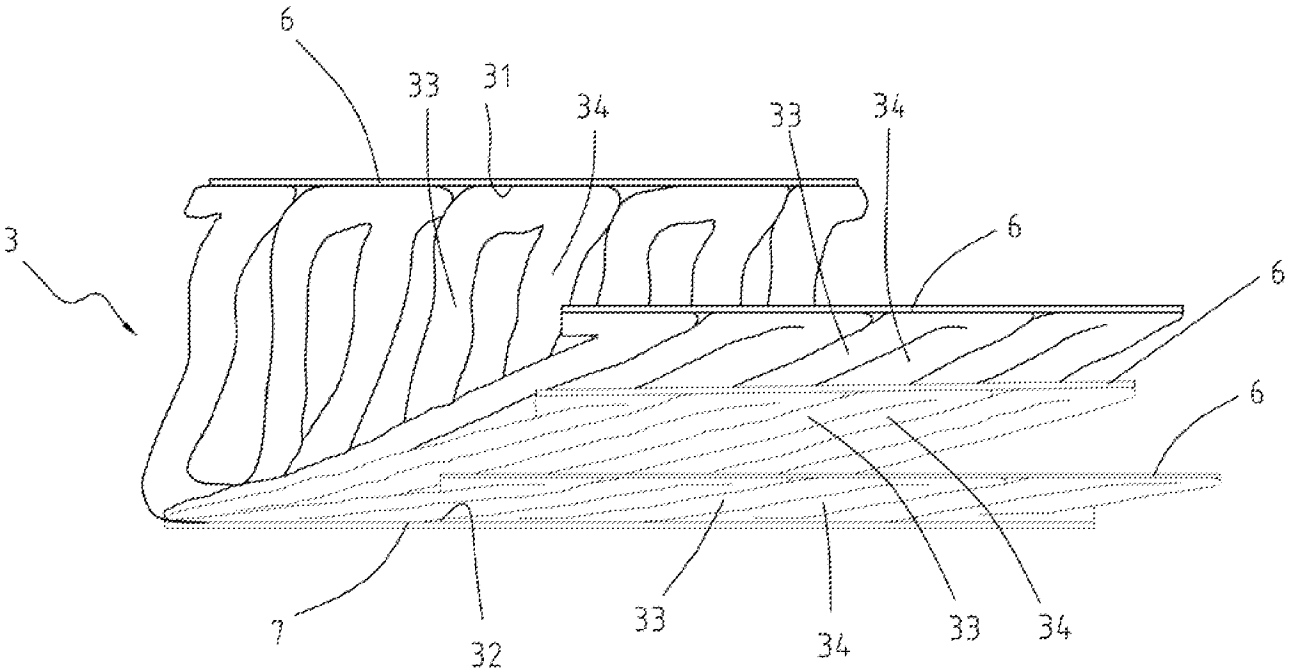
FIG. 7 is a diagram illustrating a continuation of actions of the insulated article according to the present invention between compression and recovery.

In addition, FIG. 7 shows a continuation of the actions from FIGS. 3 to 6, indicating the changes in loft of the insulated article between maximum and minimum compression (displacement is adjusted).

In the above preferred embodiments, a formula for calculating the angle (θ) of the short lap section (33) of the folded web (3) with respect to the outer shell fabric (6) and the lining fabric (7) and the horizontal displacement (c) between the outer shell fabric (6) and the lining fabric (7) is discussed in conjunction with FIG. 3. The angle (θ) of the short lap section (33) of the folded web (3) with respect to the outer shell fabric (6) and the lining fabric (7) depends on the vertical thickness (H) of the folded web (3) and the length (b) of the lap. For example, the thickness (H) of the folded web (3) is 30 mm and the length (b) of the lap is 70 mm, then the angle (θ) of the short lap section (33) of the folded web (3) with respect to the outer shell fabric (6) and the lining fabric (7) will be sin θ=30/70=25.38°. With this angle, the horizontal displacement (c) between the outer shell fabric (6) and the lining fabric (7) is about 63.24 (since $70^2$ mm−$30^2$ mm=$63.24^2$ mm).

Therefore, the present invention essentially adjusts the horizontal displacement between the outer and the lining fabrics (6) (7), so that the folded web (3) may not only recover to its original thickness (H) (or fill power), it may even surpass its original thickness (H) (or fill power). The hollow gap (9) formed after the folded web (3) is restored to its original loft can be filled up by the fluffy long lap section (34), forming the low-density region of the folded web (3). The present invention thus provides an insulated article with excellent thermal insulation, lightweight and easy to store, solving various existing problems of the prior art.

What is claimed is:

1. An insulated article that changes its fill power through adjustment in displacement, comprising a continuous slanting folded web, an outer shell fabric and a lining fabric at the top and bottom surfaces, respectively, forming a sandwich structure, the continuous slanting folded web including multiple laps connected end-to-end sequentially, and the continuous slanting folded web is made from a spread continuous filament tow band, wherein each lap of the continuous slanting folded web is characterized by width and length and forming an angle with respect to the outer shell fabric or the lining fabric, and a section of each lap attached to the outer shell fabric and a section of each lap attached to the lining fabric are attachment areas, the sections of the laps attached to the outer shell fabric are connected together, and the sections of the laps attached to the lining fabric are connected together, and each lap includes a front short lap section and a back long lap section according to the direction in which it slants, the front short lap section of each lap connects end-to-end to the back long lap section, and the back long lap sections of the laps are non-adhered to the front short lap sections of the laps side by side, wherein the front short lap section forms a linked bridge with the outer shell fabric and the lining fabric and moves in concert with the attachment areas, while the back long lap section is loose and fluffy.

2. The insulated article of claim 1, wherein the slanting angle of each lap of the folded web is less than 90°.

3. The insulated article of claim 1, wherein the slanting angle is the angle of the short lap section of the folded web with respect to the outer shell fabric or the lining fabric.

4. The insulated article of claim 1, wherein when the insulated article is not compressed, the folded web includes slanting laps overlapping each other.

5. The insulated article of claim 1, wherein the thickness of the sandwich structure represents the fill power of the insulated article, and a horizontal distance formed between a certain point on the outer shell fabric and a certain point on the lining fabric represents a horizontal displacement between the outer shell fabric and the lining fabric.

6. The insulated article of claim 5, wherein when the horizontal displacement between the outer shell fabric and the lining fabric is adjusted to close zero, or the angle of the lap formed with respect to the outer shell fabric or the lining fabric is close to 90°, a gap is formed between each lap of the folded web, and the loose long lap section then fills up the gap, and fluffy fibers in portions of the folded web not adhered to the outer shell fabric and the lining fabric also fill up the gap, forming a low-density region in the structure.

7. The insulated article of claim 6, wherein the angle of the lap formed with respect to the outer shell fabric or the lining fabric is greater than 90°.

* * * * *